United States Patent [19]

Burke et al.

[11] Patent Number: 4,705,181

[45] Date of Patent: Nov. 10, 1987

[54] SAFETY CAP FOR CONTAINERS OF LIQUIDS

[75] Inventors: Peter A. Burke, Downingtown, Pa.; Walter Duering, Zurich; Martin Gut, Daellikon, both of Switzerland

[73] Assignee: Kiwi Brands, Inc., North Douglasville, Pa.

[21] Appl. No.: 904,654

[22] Filed: Sep. 5, 1986

[51] Int. Cl.[4] ..... B65D 55/02

[52] U.S. Cl. ..... 215/220; 215/213; 215/218; 215/31; 222/153

[58] Field of Search ..... 215/211, 213, 218, 219, 215/220, 31; 222/153, 546, 562, 563

[56] References Cited

U.S. PATENT DOCUMENTS

| | | | |
|---|---|---|---|
| 3,549,053 | 12/1970 | Anderson | 222/153 |
| 3,623,623 | 11/1971 | Bauer | 215/213 |
| 3,731,849 | 5/1973 | Burrows | 222/153 |
| 3,878,961 | 4/1975 | Curry et al. | 215/219 |
| 4,220,247 | 9/1980 | Kramer | 215/220 |
| 4,257,561 | 3/1981 | McKinney | 222/153 |
| 4,334,638 | 6/1982 | Stock | 222/153 |
| 4,609,114 | 9/1986 | Roy | 215/220 |

*Primary Examiner*—Stephen Marcus

*Assistant Examiner*—Nova Stucker

*Attorney, Agent, or Firm*—Steele, Gould & Fried

[57] ABSTRACT

A child-resistant safety cap for a container for liquids such as strong cleaners has an inner cap and an outer cap selectively engagable by teeth on the caps requiring axial pressure on the outer cap to engage and threadably loosen the inner cap from a neck of the container. The inner cap includes a protruding plug member that extends into a free end of a nozzle on the container, spaced from the threaded part of the container neck. Cylindrical inner surfaces of the outer cap conform to outer surfaces of the inner cap, the inner and outer caps remaining closely aligned with respect to the container neck. Complementary structure between the inner cap and the nozzle engage when the inner cap is fully tightened. The safety cap closes a container having an S-shaped bend accumulating a charge of liquid in a trap in the bend, the nozzle having a rearward conduit part reaching into the trap. The inner and outer caps engage by engagement teeth on one of the caps that engage perpendicular stops in the facing cap, the teeth having a surface sloped with respect to a radial plane in a cap-loosening direction, and a perpendicular abutment in a cap-tightening direction. Preferably, the sloping plane is oriented at about 50 degrees to the radial plane.

11 Claims, 9 Drawing Figures

SAFETY CAP FOR CONTAINERS OF LIQUIDS

BACKGROUND OF THE INVENTION

1. Field of the Invention

This invention relates to the field of safety caps, and in particular to a child-resistant safety cap especially useful for liquid containers, and to a particular liquid container for use with the cap.

2. Prior Art

A wide variety of safety caps are known in which inner and outer caps are made axially separable such that when rotated in a direction that would threadably loosen the cap from its container, axial pressure on the outer cap is necessary to engage an inner cap and thereby remove the cap from the container. These devices have in common the attribute that the inner part of the outer cap is some way spaced from or larger than the outer part of the inner cap. The inner and outer caps are brought together by misaligning the outer cap with respect to the inner cap (e.g., by tilting the outer cap on the inner cap), by axially displacing the outer cap with respect to the inner cap, or by pinching the outer cap to deform the outer cap onto the inner cap. The user is then able to manually engage the inner cap and unthread the inner cap from the container.

A child-resistant cap is unfortunately also sometimes inherently adult resistant as well. Caps that require undue pressure either axially or radially may be too difficult for adults to operate, especially where the adult suffers from an arthritic condition or the like. In many prior art designs, the extent of axial or radial pressure which must be applied to loosen the cap is largely dependent upon how tight the inner cap happens to be threaded down on the container. For example, prior art designs are known with tapered pins, inclined surfaces or rounded pins or bumps. Examples are disclosed in U.S. Pat. Nos. 2,847,139—Christiansson et al (tapered pins); 1,061,214—Sentman (bumped); 4,241,840—Willis (inclined teeth); and 3,888,375 (sloping surfaces). Some of these rely on radial pressure in addition to axial pressure. Substantial axial pressure is required to maintain engagement between the inner and outer caps when the inner cap is threaded tightly on the container.

Prior art caps may have a central pin for centering a part of the outer cap on the inner cap, for example as in 4,353,474—Luker. Such caps typically permit substantial axial misalignment of the inner cap with respect to the bottle, or of the outer cap with respect to the inner cap. The characteristic looseness of these two-part caps frequently aggravates the difficulty of all persons, including adults, in opening the child-resistant cap. The loose feel of easily-misaligned devices offends the user's sense of security when the container is being closed. Inasmuch as these caps are intended to isolate materials that could be dangerous to children, for example drugs, cleaning chemicals and the like, the user is inclined to tighten the closure as securely as reasonably necessary. When the cap feels sloppy and loose, the user is inclined to tighten that much harder, to overcome the lack of security evidenced by the loose feel. Overtightening may result in a very difficult time in opening the container the next time the material therein is needed.

The present invention maintains precise axial alignment between the inner cap and the neck of the bottle by engagements located at two areas spaced along the axis. The inner cap is carried on the container by threads along the container neck, as is conventional.

However, the inner cap of the invention is also aligned with respect to the container at the extreme end of a nozzle extending from the threaded part of the container. Therefore, the inner cap remains relatively securely aligned to the bottle even as the inner cap is loosened on the container.

The invention further employs a direction-sensitive engagement structure between the inner and outer cap that is characterized by facing perpendicular surfaces operative in the tightening direction, and sloping surfaces operative in the loosening direction. The sloping surfaces define an incline of from 40 to 70 degrees, preferably about 50 degrees to horizontal, and a perpendicular stop is applied to each sloping surface in loosening the closure. Therefore, when tightening the top down on the container, the user is most secure in that even without axial pressure the outer cap is perpendicularly engaged against the inner cap and the inner cap is precisely and securely aligned with respect to the bottle. The user is not inclined to exert a great deal of effort in overcompensating for perceived looseness and in overtightening the cap. Instead, the user is able to feel the snugness of connection as the cap is fully tightened. Additional engagement structure between the inner cap and a nozzle portion in the neck of the container preferably adds to the user's confidence by providing a tactile indication of full engagement of the inner cap to the neck, and accordingly to the nozzle.

The cap of the invention is preferably used for containers of strong cleaning chemicals such as toilet bowl cleaner. The safety cap is affixed to a nozzle member removably placed in the neck of the bottle, the nozzle having a part defining a liquid conduit extending out of the neck, and also extending downwardly into the container, the conduit being aligned axially along the neck. The neck is provided with a S-shaped bend, the uppermost bend of the S-shape defining the lowermost reach of the nozzle. In use, the user tips the bottle to fill a liquid trap defined by the S-shaped bend. In squeezing the bottle or otherwise extracting the liquid, the user has only to pressurize the charge of material residing in the trap of the S-shape bend. This structure provides additional safety and assurance to the user.

Unlike prior art devices in which a loosely-mounted outer cap is attached to an inner cap by means of an axial pin or similar structure, the present invention has an inner cap attached to a nozzle by such a pin. The inner cap is also, of course, attached to the neck of the container by its threads. Therefore, axial alignment is achieved without the possibility of the pin-supported cap wobbling with respect to the pin, as occurs in prior devices. This additional alignment and security prevents users from inadvertently overtightening the inner cap to overcome a misperceived lack of secure sealing, and later having difficulty or accidents in removing the inner cap.

SUMMARY OF THE INVENTION

It is an object of the invention to provide a child-resistant safety cap that is resistant to children but easily operable by adults.

It is also an object of the invention to discourage inadvertent overtightening of a safety cap due to inherent looseness of the safety cap construction.

It is another object of the invention to ensure precision in alignment between an inner part of a safety cap and a container neck, and between an outer part of the safety cap and the inner part.

It is another object of the invention to provide a very secure tightening structure in a safety cap, whereby the user is disinclined to overtighten the cap.

It still another object of the invention to provide a selective engagement structure between rotatable inner and outer caps characterized by engagement teeth having a sloping side in an threading direction for cap removal and a secure abutment in a threading direction for cap tightening.

These and other objects are accomplished by a safety cap for a container for liquids such as toilet bowl cleaners and the like, having an inner and outer cap including direction-sensitive engagable teeth on one of the inner and outer cap requiring axial pressure to threadably loosen the cap. A nozzle protrudes from the container neck. The inner cap is threadable over the nozzle on a neck of the container, and also includes a protruding plug member that extends into a free end of the nozzle, spaced from the threaded part of the container neck. The outer cap and the inner cap have conforming cylindrical surfaces, the inner and outer cap remaining axially aligned with respect to the container neck. Complementary engagement teeth can also be provided between the inner cap and the nozzle. The safety cap is used on a container having an S-shaped bend at the neck, thereby accumulating a charge of liquid in a trap in the bend by tilting of the container. The preferred engagement teeth between the inner and outer caps engage perpendicular stops in the facing member, the teeth having a surface sloped with respect to a radial plane in one direction, and a perpendicular abutment opposite thereto. Preferably, the sloping plane is oriented at about 50 degrees to the radial plane.

BRIEF DESCRIPTION OF THE DRAWINGS

There are shown in the drawings the embodiments that are presently preferred. It should be understood that the invention is not limited to the precise arrangements and instrumentalities shown in the drawings and that the invention is capable of embodiment wherein the illustrated features are employed in various combinations, within the spirit of the invention. In the drawings.

DETAILED DESCRIPTION OF THE PREFERRED EMBODIMENTS

Figure 1:
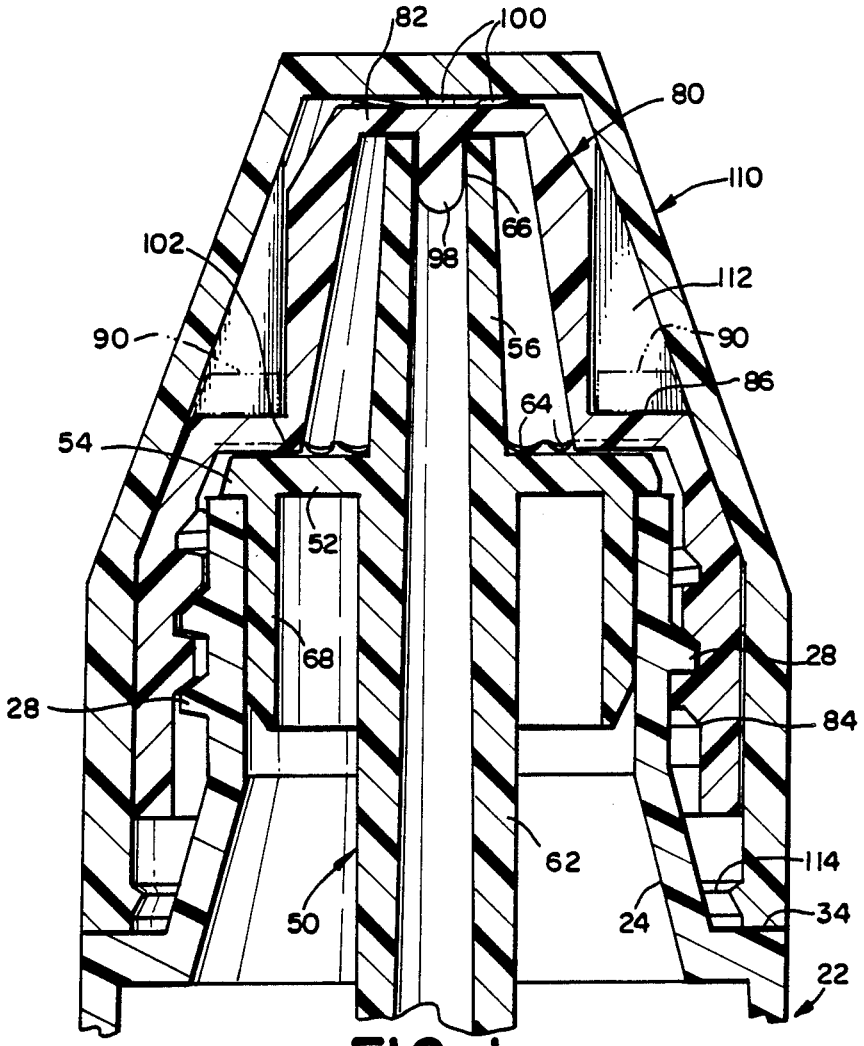
FIG. 1 is a longitudinal section view through a child-resistant safety cap and container according to the invention.

FIG. 1 shows a preferred embodiment of the invention in section, the parts being shown assembled and the child-resistant closure being attached to the container. FIG. 1 shows only the extreme end of the container 22, namely neck portion 24, to which a nozzle 50, inner cap 80 and outer cap 110 are attached. The outer cap 110 is captive on the inner cap 80, and a range of axial displacement of outer cap 110 upward with respect to inner cap 80 is allowed by the complementary structures of the inner and outer caps. Above a predetermined upward axial displacement, the caps are relatively rotatable. A ridge 114 around the lowermost edge of outer cap 110 defines a diameter slightly smaller than the outer diameter of the lower edge of inner cap 80, whereby outer cap 112 can be axially lifted only by the axial distance between ridge 114 and the lower edge of inner cap 80 as shown in FIG. 1. During assembly, the inner cap is forced past ridge 114, the latter being slightly expandable. Over the permitted span of axial movement, the inner portions of outer cap 110 and the outer portions of inner cap 80 are closely matched in dimensions, such that the outer cap 110 will remain closely aligned to the inner cap and therefore to the axis of neck 24.

The inner portions of inner cap 80 are urged downwardly to seal the container, inner cap 80 mating with threads 28 on neck 24 of container 22. As the inner cap is rotated, preferably clockwise on a right-handed thread 28, the inner cap is urged axially downwardly onto neck 24. This causes a plug member 98 at the extreme end 82 of inner cap 80 to be forced downwardly to close the open end 66 of nozzle member 50. At the same time, an inner side of a plateau portion 86 of the inner cap bears downwardly on a plate portion 52 of nozzle member 50. Flange edges 54 of plate portion 52 of the nozzle member are slightly larger than the opening defined by the open end 26 of neck 24 of the bottle, such that threadable tightening of inner cap 80 is eventually stopped when nozzle 50 is in the position shown in FIG. 1.

A barrel portion 68 of nozzle 50 extends downwardly into neck 24 of bottle 22, thereby providing a seal with the inner surface of neck 24 that prevents any passage of liquid between nozzle 50 and container 22. The conduit defined by nozzle 50 extends rearwardly into the bottle through an extending portion 62 that takes up liquid in the "S" bend back from the end of the neck and carries the liquid to the discharge of the nozzle, for example when the bottle is squeezed or when pressure is otherwise applied.

The outwardly-directed face of plate portion 52 of nozzle 50 has a plurality of radial ridges 64 that mate with complementary radial troughs 102 in the inner surface of plateau 86 of inner cap 80. Accordingly, when the inner cap is fully tightened and plateau 86 begins to bear down on plate 52 of nozzle 50, the user is provided a tactile indication of this fact because the ridges 64 and troughs 102 engage and disengage with relative rotation of inner cap 80 and nozzle 50. Ridges 64 and troughs 102 are relatively shallow in that they are not provided for particular structural engagement between the inner cap and the nozzle, but instead prevent the user from continuing to twist and tighten the inner cap once an appropriate tightness is achieved.

The outwardly-directed surface of plateau 86 of inner cap 80 is provided with specifically-shaped protrusions 90. These protrusions mate with stops 112 that extend inwardly from the inner surface of outer cap 110. As the outer cap is rotated to tighten the inner cap, for example clockwise on a right handed thread 28, stops 112 bear squarely against the rear sides 94 of protrusions 90, the rear sides 94 each being perpendicular to plateau 86 and occupying a substantially radial plane along the axis of the container neck. Both stops 112 and rear sides 94 being aligned, the outer and inner caps are not urged to disengage. Accordingly, the inner cap is securing engaged and tightened. When the outer cap is rotated in the opposite direction to loosen the inner cap, for example counterclockwise on a right handed thread 28, the stops 112 encounter sloping faces 92 of protrusions 90. As the user turns the outer cap counterclockwise, the lowermost parts of stops 112 tend to slide upward over sloping faces 92 of protrusions 90, causing the outer cap 110 to be axially displaced upwards until disengaged from inner cap 80. Meanwhile, the inner cap and nozzle are at least partly rotationally fixed by ridges 64 and troughs 102. This prevents a user from gaining enough engagement between outer cap 110 and inner cap 80 to loosen the inner cap and open the container, unless the user is able to exert sufficient axial pressure downwardly on the outer cap to prevent stop 112 from sliding up inclined face 92 of protrusions 90.

The relative dimensions of protrusions 90, slopes 92, troughs 102 and ridges 64 can be varied somewhat to make opening easier or more difficult. It is currently preferred that ridges 64 and troughs 102 be about 0.5 mm deep and that slope 92 be about 50 degrees, for a neck of about 3 cm diameter. Protrusions 90 preferably extend axially about 2 mm. If ridges 64 and troughs 102 are relatively deep, the inner cap may also engage and rotate nozzle member 50 in the container neck.

Figure 2:
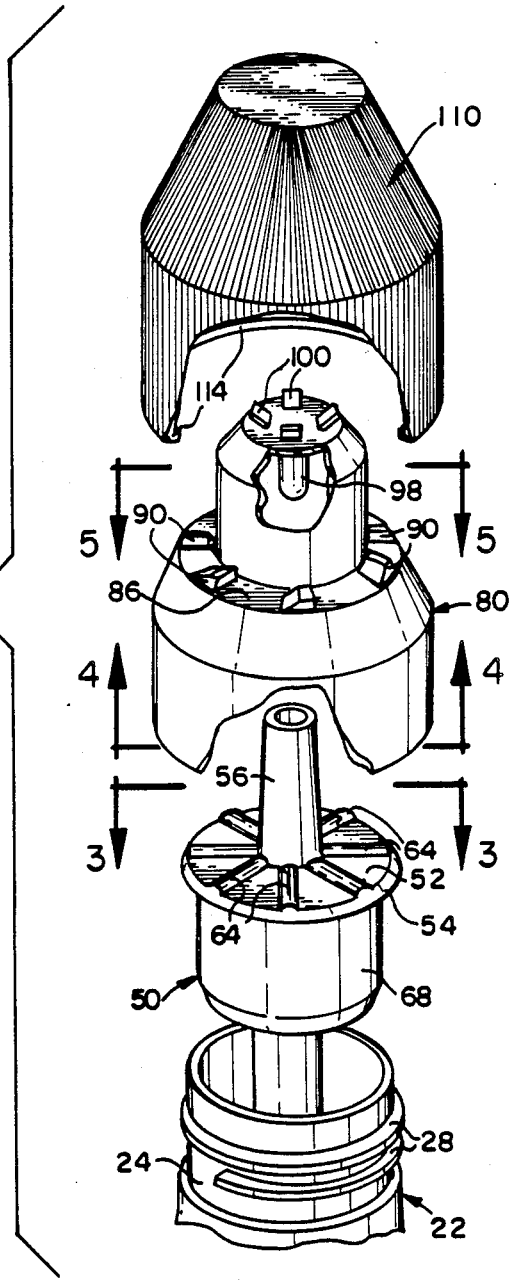
FIG. 2 is a partially cut away exploded perspective view of the neck of the container and safety cap elements.

FIG. 2 shows an alternative embodiment in exploded view. As also shown in FIG. 1, the nozzle member 50 is snugly secure in neck 24 of container 22 by means of barrel portions 68 that is dimensioned to be closely fitted into the container neck. The lowermost edge of barrel portion 68 may be chamfered as shown in FIG. 1, to assist in forcing the nozzle 50 securely into neck 24. Once secured, liquid can pass out of container 22 only through the conduit within nozzle 50, and is discharged, for example upon squeezing the bottle, through extension 56 that protrudes above the opening edge of the container neck 24. Nozzle 50 can only be moved into neck 24 until flange 54 engages the uppermost part of neck 24. This occurs when inner cap 80 is threaded downwardly on threads 28 of neck 24, to bear against surface 52 of nozzle 50.

Figure 3:
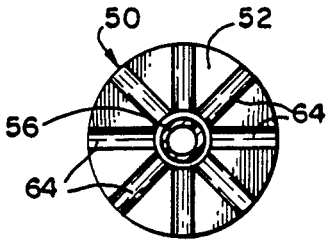
FIG. 3 is a partial section view taken along lines 3—3 in FIG. 2.
Figure 4:
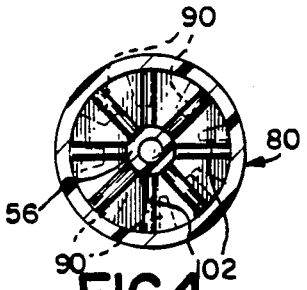
FIG. 4 is a partial section view taken along lines 4—4 in FIG. 2.

FIG. 3 illustrates the upwardly-facing surface 52 of nozzle 50. A plurality of radially-oriented ridges 64 are directed upwardly to engage on the lower-facing surface of inner cap 80, i.e., on the inner side of plateau 86. Adjacent extension 56 of nozzle 50, the inner cap may be spaced from the nozzle, or may fit closely over the nozzle. As shown in FIG. 1, it is preferred that the ridges 64 be continuous only near the circumferential end of plate portion 52, where the inner cap bears down on the nozzle 50, compressing flange 54 between edge 26 of container neck 24 and the inner surface of the inner cap. The inner surface of the inner cap is shown in FIG. 4. Complementary troughs 102, also aligned radially, are provided to mate with ridges 64 on the upper surface of the nozzle. It will be appreciated that it is also possible to wholly or partly reverse the male/female sense of engagement between inner cap 80 and nozzle 52, that is, providing downwardly-protruding ridges on the inner cap, to mate with corresponding radial troughs in plate 52 of nozzle 50.

The inner and outer caps, and the nozzle portion, are preferably molded as relatively-thin plastic bodies. Accordingly, protrusions 90 need not be solid plastic parts, but can be formed by displacing the thin sheet material at plateau 86 upwardly, thereby forming depressions in the underside of plateau 86 and protrusions above. The depressions, as shown in FIG. 4, are pressed upwardly in the area of the radial troughs 102.

As shown in FIG. 2, it is also possible to have a resilient means positively urge the outer cap axially upwardly from the inner cap. For example, a series of angularly-protruding tabs 100 can be provided, for example at the extreme end 82 of the inner cap, to urge the outer cap axially away from the inner cap. Uses are then required to overcome this resilience as well as the sloped engagement between stops 112 of the outer cap and protrusions 90 of the inner cap. Protrusions 100 make the container substantially more difficult to open, but may be justified in the event that the container 22 is used to store particularly-dangerous liquid or the like.

Figure 7:
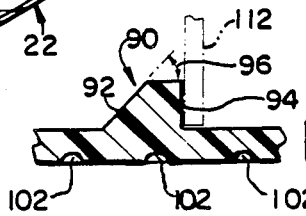
FIG. 7 is a partial section taken along lines 7—7 in FIG. 5.
Figure 5:
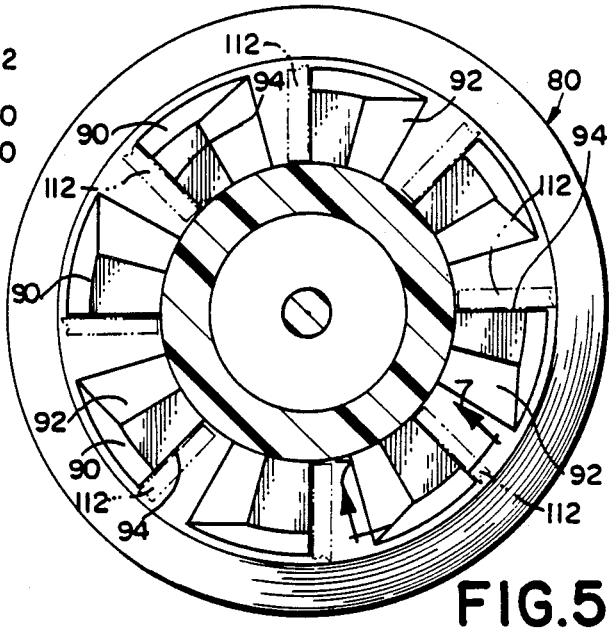
FIG. 5 is a section view taken along lines 5—5 in FIG. 2.

Protrusions 90 of the inner cap 80 are shown in detail in FIGS. 5 and 7. Stops 112 of the outer cap are shown in phantom lines. Inasmuch as the center lines of stops 112 are oriented radially, the perpendicular edges 94 and sloping faces 92 of protrusions 90 must be oriented slightly off exact radii, in order to account for the width of stops 112. Preferably, the angle defined by sloping face 92 to the plateau surface 86 of inner cap 80, is in the range of 40–70 degrees. The lower the angle 96 of sloping face 92, the greater the axial pressure required to maintain enough physical engagement between the outer and inner cap to disengage ridges 64 and troughs 102. Particularly advantageous results are achieved at about 50 degrees for angle 96. It will be appreciated that a steeper or shallower angle may also be appropriate depending on the expected contents.

According to the invention, the inner cap remains axially aligned to the nozzle, and accordingly to the neck 24 of container 22, by engagement with threads 28, and also by engagement between plug 98 and the end 66 of nozzle 50. Inasmuch as threads 28 extend downwardly from the opening edge 26 of container 22, and end 66 is spaced substantially above opening end 26, the inner cap is supported with respect to the bottle at points which are axially well-spaced from one another. This fact results in a very secure axial alignment of the inner cap to the nozzle and to neck 24 of container 22. Furthermore, the radially-inwardly directed parts of stops 112, and the inner walls of outer cap 110 define cylindrical surfaces that precisely but movably match the outer dimensions of the inner cap, and thereby achieve the same secure axial alignment of the outer cap to the inner cap and hence to the neck. Therefore, as the user tightens the outer cap on the inner cap, the user finds no looseness of connection as is characteristic of initial engagement of threaded surfaces. In other words, the cap feels very precise and the user is tactilely assured that the cap is being attached correctly.

Figure 6:
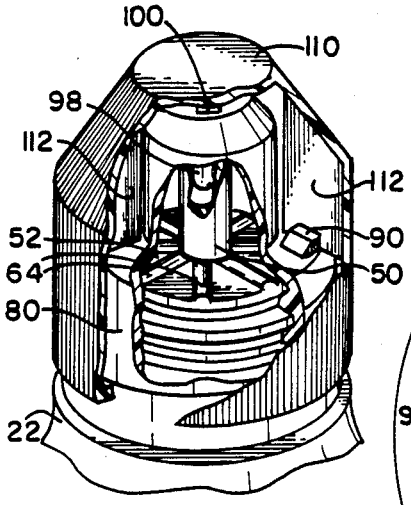
FIG. 6 is a cut away perspective view of the safety cap as assembled.

A cutaway illustration of the cap as assembled is shown in FIG. 6, and corresponds substantially to FIG. 1. Plug 98 of the inner cap extends into the opening end of nozzle 50, whereby inner cap 80 is supported at its lowermost edge by the threads and at its uppermost central part by plug 98. As the user tightens outer cap 110, stops 112 engage behind the protrusions 90, which have a substantially trapezoidal cross section, and inasmuch as stops 112 and protrusions 90 engage squarely, there is no axial pressure required for tightening. When the inner cap is fully tightened, the ridges 64 and troughs 102 on facing surfaces of the inner cap and the nozzle plate 52 come into contact. The outer cap encounters an increased resistance, and as the ridges and troughs come into contact, which is transmitted to the user indicating adequate tightening. With this improved alignment and tactile indication, the user is not led by a loose outer cap to overtighten the inner cap on the container neck. Instead, a repeatable tightness is achieved. Upon loosening, the ridges 64 and troughs 102 present some initial untightening resistance as well.

Figure 8:
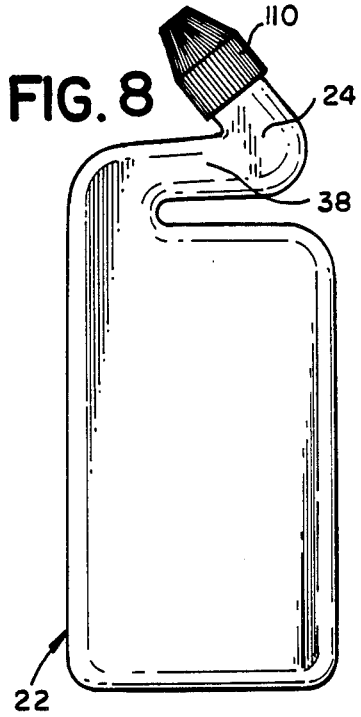
FIG. 8 is an elevation view of a liquid container according to the invention.
Figure 9:
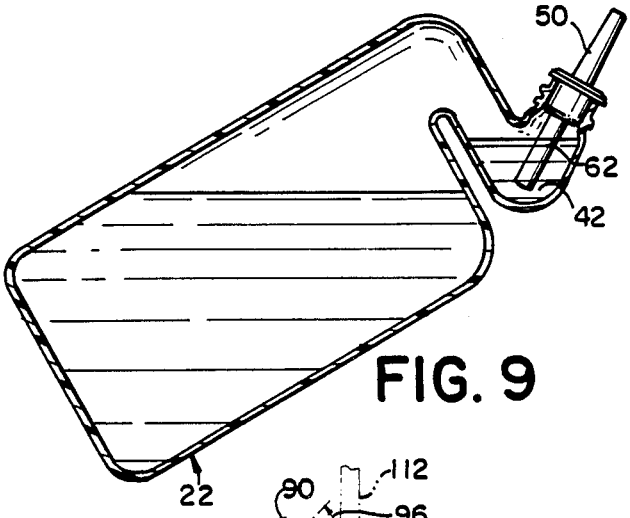
FIG. 9 is a cut away view of the container showing the container and nozzle in use.

The child-resistant cap of the invention is preferably used with liquid containers for such products as toilet bowl cleaners which are quite corrosive. In a simple squeeze container 22 as shown in FIGS. 8 and 9, the child-resistant cap is especially useful. An S-shaped bend 38 is formed in the neck 24 of the container. Therefore, when the user tilts the container 22, a quantity of fluid becomes trapped in the S-shaped bend at a trap portion 42. The rearward-extension 62 of nozzle 50 is sized to extend just to the bottom of trap 42 in S-shaped bend 38. When the user then squeezes the bottle, a repeatable charge of liquid is expelled through nozzle 50, which is appropriately aligned. When the container 22 is again placed upright, the trapped material flows back to the body of container 22, the S-shaped bend 38 preferably having a horizontal or nearly horizontal lowermost section.

The particular child-resistant cap of the invention is quite precise yet may be made of inexpensive thin molded plastic parts. Variations on the concept may include a reversal of the sense of the mating parts, for example placing sloped protrusions 90 on the outer cap rather than the inner cap and the like. Other variations will now be apparent to persons skilled in the art. Reference should be made to the appended claims rather than the foregoing specification to assess the true scope of the subject invention.

What is claimed:

1. A safety cap for a liquid container, the container having an externally-threaded neck defining an axis, the safety cap comprising:

a nozzle disposed on the threaded neck, the nozzle defining a conduit for liquid and having a tubular protrusion of the conduit extending along the axis past the neck;

an inner cap having an inner surface and an outer surface, the inner surface being threaded to engage the neck, the inner surface having a sealing plug protruding into the nozzle to seal the conduit at an end of the tubular protrusion, the outer surface having a plurality of teeth, spaced radially from the axis and circumferentially around the outer surface, each tooth having a trapezoidal cross section, the teeth having sloping sides oriented in a first direction around the cap, and relatively more-perpendicular sides oriented in an opposite direction around the cap; and, an outer cap having an inner surface substantially conforming to the outer surface of the inner cap, the outer cap having an engagement part clasping the inner cap, the outer cap being thereby captive on the inner cap and movable axially on the inner cap, the outer cap having a plurality of stops extending axially and radially inwardly toward the teeth of the inner cap, the stops of the outer cap engaging the more-perpendicular sides of the teeth when the outer cap is rotated to tighten the inner cap on the neck, the stops of the outer caps sliding over the sloping sides of the teeth and the outer cap being axially displaced from the inner cap when the outer cap is rotated in a direction to loosen the inner cap on the neck;

whereby axial pressure on the outer cap is required to move the inner cap and the outer cap and inner cap remain aligned to the neck.

2. The safety cap of claim 1, wherein the nozzle is a separable part sealing disposed on the neck and the protrusion of the conduit is of substantially smaller diameter than the neck, and further comprising a flange on the nozzle closing an opening edge of the neck, and a body of the nozzle extending into the neck.

3. The safety cap of claim 2, further comprising an extension of the conduit of the nozzle, extending rearwardly into the container.

4. The safety cap of claim 2, wherein the flange of the nozzle and the inner surface of the inner cap have complementary mating structures whereby the inner cap is secured to the nozzle when threaded fully onto the neck.

5. A safety cap according to claim 1, wherein the sloping sides of the teeth have an angle of about 40 to 70 degrees relative to a radial plane around the axis.

6. The safety cap of claim 5, wherein the relatively more sloping sides have an angle of about 50 degrees relative to said radial plane.

7.The safety cap of claim 6, further comprising a resilient member attached to one of the inner and outer caps and operable to resiliently space the inner and outer caps along the axis, the resilient member being compressed with axial pressure on the outer cap.

8. A safety container for liquids, comprising:

a container body having an opening with a threaded neck and a thin nozzle extending from the neck along an axis of the threaded neck;

an inner cap having a threaded inner surface for engaging the neck, and a plug directed inwardly to engage the nozzle at an opening end of the nozzle, the protrusion and inner surface aligning the inner cap to the neck;

an outer cap fitting over the inner cap and captive on the inner cap, the outer cap being rotatable and axially movable relative to the inner cap; and, axially-oriented complementary mating structures on the inner and outer cap, said complementary mating structures being engaged along radial surfaces when the outer cap is rotated in a direction to tighten the inner cap on the neck and the complementary mating structures being sloped to axially separate and disengage the inner and outer cap when rotated opposite said direction to tighten the inner cap on the neck.

9. The container of claim 8, wherein the axis is oriented about 45 degrees from a longitudinal axis of the container.

10. A child-resistant bottle for a liquid, comprising:

a container for the liquid, the container having a neck defining an S-shaped trap, the neck being threaded;

a nozzle inserted into the neck, the nozzle having a conduit extending outwardly from the neck, the conduit opening at a space above the neck, and the conduit extending backward to a bend in the S-shaped trap;

a safety cap having an inner cap and an outer cap, the inner and outer caps being engaged when rotated to tighten the safety cap and requiring axial pressure on the outer cap to engage and loosen the inner cap, the inner cap having a plug spaced from the neck of the container, the plug being operable to close the conduit above the neck, and the plug and inner threads on the inner cap orienting the safety cap to the neck of the container.

11. The container of claim 6, wherein the bend includes a first portion oriented about 45 degrees to a longitudinal axis of the container, and a second portion attached to said first portion, oriented substantially perpendicular to said longitudinal axis of the container, the conduit of the nozzle extending into a junction between said first and second portions.

* * * * *